US011069976B1

(12) United States Patent
Xi et al.

(10) Patent No.: US 11,069,976 B1
(45) Date of Patent: Jul. 20, 2021

(54) PHASED-ARRAY ANTENNA AND CONTROL METHOD OF THE SAME

(71) Applicants: Shanghai Tianma Micro-Electronics Co., Ltd., Shanghai (CN); Chengdu Tianma Micro-Electronics Co., Ltd., Chengdu (CN)

(72) Inventors: Kerui Xi, Shanghai (CN); Tingting Cui, Shanghai (CN); Boquan Lin, Shanghai (CN); Feng Qin, Shanghai (CN); Xuhui Peng, Shanghai (CN); Qinyi Duan, Shanghai (CN)

(73) Assignees: Shanghai Tianma Micro-Electronics Co., Ltd., Shanghai (CN); Chengdu Tianma Micro-Electronics Co., Ltd., Chengdu (CN)

( * ) Notice: Subject to any disclaimer, the term of this patent is extended or adjusted under 35 U.S.C. 154(b) by 0 days.

(21) Appl. No.: 16/915,992

(22) Filed: Jun. 29, 2020

(30) Foreign Application Priority Data

Apr. 15, 2020 (CN) ..... 202010294206.5

(51) Int. Cl.

| | |
|---|---|
| ***H01Q 3/36*** | (2006.01) |
| ***H01Q 5/321*** | (2015.01) |
| ***H01Q 5/335*** | (2015.01) |
| ***H01Q 13/18*** | (2006.01) |

(52) U.S. Cl.
CPC ..... *H01Q 3/36* (2013.01); *H01Q 5/321* (2015.01); *H01Q 5/335* (2015.01); *H01Q 13/18* (2013.01)

(58) Field of Classification Search
CPC ..... H01Q 5/335; H01Q 5/321; H01Q 3/36; H01Q 13/18
See application file for complete search history.

(56) References Cited

U.S. PATENT DOCUMENTS

| | | | | |
|---|---|---|---|---|
| 2019/0103671 | A1* | 4/2019 | Dong | H01Q 9/0407 |
| 2019/0319325 | A1* | 10/2019 | Zhang | H01Q 3/36 |
| 2020/0099115 | A1* | 3/2020 | Sun | H01Q 3/36 |
| 2020/0185836 | A1* | 6/2020 | Wang | H01Q 1/364 |
| 2020/0243969 | A1* | 7/2020 | Fang | H01P 1/184 |
| 2020/0257149 | A1* | 8/2020 | Li | G02F 1/1343 |

FOREIGN PATENT DOCUMENTS

| | | | |
|---|---|---|---|
| CN | 107658547 | A | 2/2018 |
| CN | 108808181 | A | 11/2018 |
| CN | 110649356 | A | 1/2020 |

* cited by examiner

*Primary Examiner* — Lam T Mai
(74) *Attorney, Agent, or Firm* — Alston & Bird LLP

(57) ABSTRACT

The present disclosure provides a phased-array antenna and a control method thereof. The phased-array antenna includes two parallel substrates attached by sealant into a cavity filled with liquid crystals, a plurality of phase-shifting units is provided in the cavity defined. Each unit comprises: a power feeder electrically connected to a radio frequency signal terminal, a radiator electrically connected to the power feeder, a ground electrode electrically connected to a ground signal terminal but electrically insulated from the power feeder and the radiator respectively, and a driving electrode electrically connected to a control signal wire. The orthographic projections of the driving electrode, the power feeder, and the ground electrode overlap on one substrate.

18 Claims, 10 Drawing Sheets

PHASED-ARRAY ANTENNA AND CONTROL METHOD OF THE SAME

CROSS-REFERENCE TO RELATED APPLICATIONS

The present application claims priority to Chinese Patent Application No. CN202010294206.5, filed on Apr. 15, 2020, the content of which is incorporated herein by reference in its entirety.

TECHNICAL FIELD

The present disclosure relates to the technical field of electromagnetic waves, and particularly, to a phased-array antenna and a control method thereof.

BACKGROUND

With the advance in communication systems, the phased-array antenna has been widely used. In the related art, the phased-array antenna includes a plurality of antenna units, each of the antenna units makes a phase-shift to a radio frequency signal and radiates a phase-shifted radio frequency signal. The radio frequency signals radiated by the plurality of antenna units mutually interfere with each other to form a wave beam having a main lobe direction. The existing phase shifters are fixed phase-shifting devices. Thus, if each antenna unit includes only one phase shifter, one antenna unit can radiate radio signals of only one phase, and when the radio frequency signals transmitted by the plurality of antenna units mutually interfere, the antenna can only form a wave beam having a specific main lobe direction, which does not allow adjusting the main lobe direction of the wave beam. Therefore, it is preferred currently that each antenna unit correspond to a plurality of phase shifters, and different phase shifters are selected through electronic switches to perform the phase-shifting, thus allowing the radio frequency signals emitted by the antenna unit to have different phases and the main lobe direction of the phased-array antenna adjustable.

However, as a result, the number of phase shifters required in the phased-array antenna will be large if many radio frequency signals are desired, which will result in high cost and high power-consumption of the phased-array antenna. In particular, with the advent of 5G and even 6G era, the demands for the phased-array antennas are also increasing in the fields of mobile stations, vehicles, and low-orbit satellite communication systems. Therefore, it is urgent to reduce the manufacturing cost of the phased-array antennas.

SUMMARY

Embodiments of the present disclosure provide a phased-array antenna and a control method thereof, to reduce the number of phase shifters required in the phased-array antenna and reduce cost of the phased-array antenna.

In one aspect, an embodiment of the present disclosure provides a phased-array antenna, including a first substrate and a second substrate that are opposite to each other. A cavity is defined by the first substrate and the second substrate. A plurality of phase-shifting units is provided in the cavity. Each of the phase-shifting units includes: a power feeder electrically connected to a radio frequency signal terminal; a radiator electrically connected to the power feeder; a ground electrode electrically connected to a ground signal terminal and electrically insulated from the power feeder and the radiator respectively; a driving electrode provided electrically connected to one of a plurality of control signal wires and liquid crystals located between the first substrate and the second substrate. The power feeder, the radiator and the ground electrode are sequentially provided on a surface of the first substrate facing towards the second substrate, and the driving electrode is provided on a surface of the second substrate facing towards the first substrate. Orthographic projections of the driving electrode, the power feeder, and the ground electrode overlap on the first substrate.

In another aspect, an embodiment of the present disclosure provides a method of controlling the above phased-array antenna above, including: providing, by the radio frequency signal terminal, a radio frequency signal to the power feeder of each of the plurality of phase-shifting units, providing, by the ground signal terminal, a ground signal to the ground electrode of each of the plurality of phase-shifting units, and providing, by each of the plurality of control signal wires, a control signal to the driving electrode of each of the plurality of phase-shifting units; deflecting the plurality of liquid crystals of each of the plurality of phase-shifting units under an electric field formed by the driving electrode and the ground electrode in such a manner that a dielectric constant of the plurality of liquid crystals changes, so as to phase-shift the radio frequency signal transmitted in the power feeder; radiating the phase-shifted radio frequency signal through the radiator of each of the plurality of phase-shifting units; and forming a wave beam having a main lobe direction when the radio frequency signals radiated by the plurality of the phase-shifting units mutually interfere.

BRIEF DESCRIPTION OF DRAWINGS

In order to explain technical solutions of embodiments of the present disclosure, the accompanying drawings used in the embodiments are briefly described below. The drawings merely illustrate a part of the embodiments of the present disclosure. Based on these drawings, those skilled in the art can obtain other drawings without any creative efforts.

DESCRIPTION OF EMBODIMENTS

In order to explain the technical solutions of the present disclosure, the embodiments of the present disclosure are described in details with reference to the drawings. It should be understood that the described embodiments are merely parts of, rather than all of the embodiments of the present disclosure. Any other embodiments obtained by those skilled in the art without paying creative labor shall fall into the protection scope of the present disclosure.

The terms used in the embodiments of the present disclosure are merely for the purpose of describing particular embodiments, but not intended to limit the present disclosure. Unless otherwise noted in the context, the singular form expressions "a", "an", "the" and "said" used in the embodiments and appended claims of the present disclosure are also intended to indicate a plural form.

It should be understood that the term "and/or" used herein is merely for the purpose of describing three relationships of the associated objects. For example, A and/or B indicates three scenarios: only A exists; A and B exist concurrently; only B exists. In addition, a character "/" herein generally indicates that the associated objects are in an "or" relationship.

It should be understood that the substrate, the phase-shifting region, the insulating layer, and the connecting via in the embodiments of the present disclosure, which are described with the terms such as "first" and "second", are not limited to these terms. These terms are only used to distinguish the substrate, the phase-shifting region, the insulating layer, and the connecting via from one another. For example, without departing from the scope of the embodiments of the present disclosure, a first substrate may also be referred to as a second substrate, and vice versa.

Figure 1:
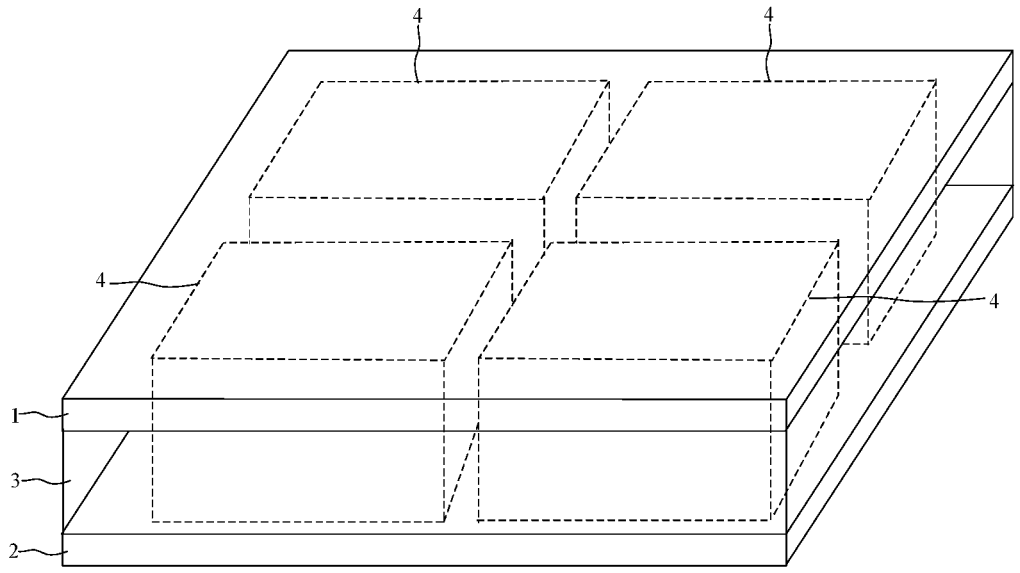
FIG. 1 is the structural schematic diagram of a phased-array antenna provided by an embodiment of the present disclosure.
Figure 2:
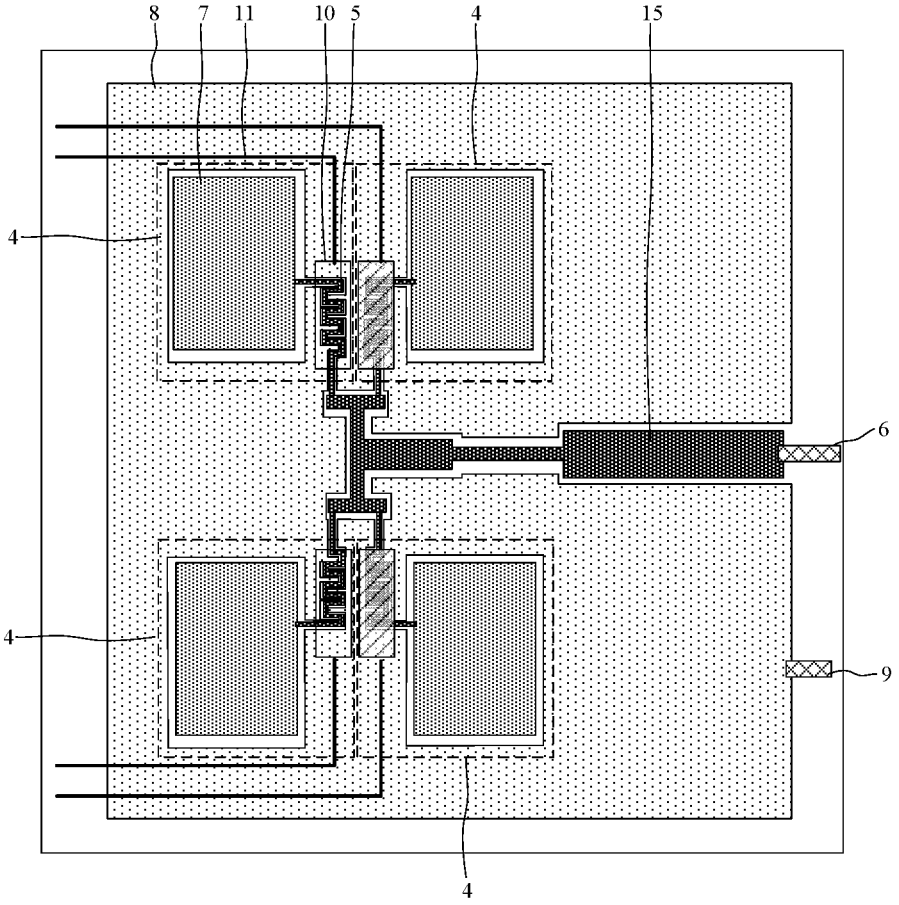
FIG. 2 is the top view of a phased-array antenna provided by an embodiment of the present disclosure.
Figure 3:
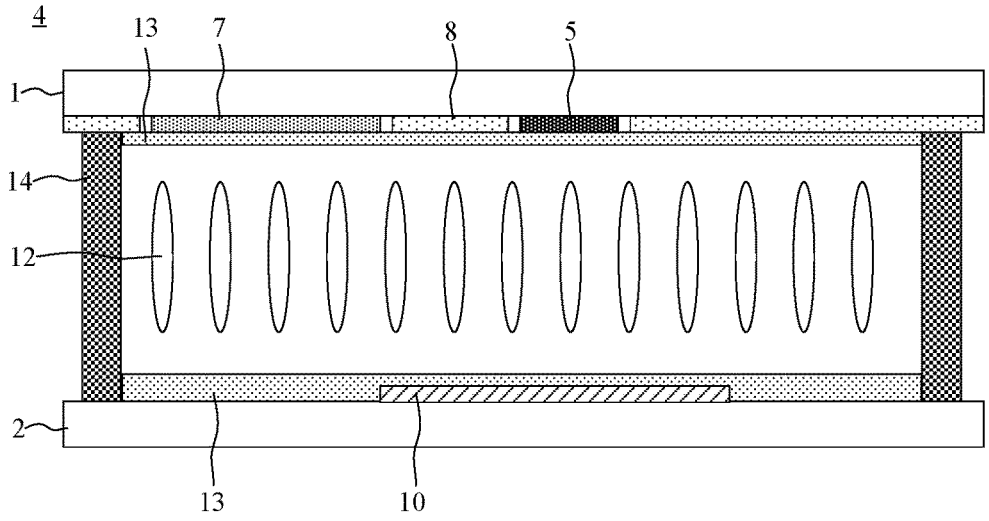
FIG. 3 is the cross-sectional view of a single phase-shifting unit of a phased-array antenna structure according to an embodiment of the present disclosure.

FIG. 1 is a structural schematic diagram of a phased-array antenna provided by an embodiment of the present disclosure, FIG. 2 is a top view of the phased-array antenna provided by the embodiment of the present disclosure, and FIG. 3 is a cross-sectional view of a single phase-shifting unit of a phased-array antenna structure according to an embodiment of the present disclosure. As shown in FIGS. 1 to 3, the phased-array antenna includes a first substrate 1 and a second substrate 2 that are disposed opposite to each other, and a cavity 3 is a space defined between surfaces of the first substrate 1 and the second substrate 2 facing towards one another. A plurality of phase-shifting units 4 is provided in the cavity 3. The first substrate 1 and the second substrate 2 are each a glass substrate, a polyimide (PI) substrate, or a liquid crystals polymer (LCP) substrate.

Each of the plurality of phase-shifting units 4 includes a power feeder 5, a radiator 7, a ground electrode 8, a driving electrode 10, and a plurality of liquid crystals 12. The power feeder 5 is provided on a surface of the first substrate 1 facing towards the second substrate 2 and electrically connected to a radio frequency signal terminal 6. The radiator 7 is provided on the surface of the first substrate 1 facing towards the second substrate 2 and electrically connected to the power feeder 5. The ground electrode 8 is provided on the surface of the first substrate 1 facing towards the second substrate 2 and electrically connected to a ground signal terminal 9, and the ground electrode 8 is electrically insulated from the power feeder 5 and the radiator 7, respectively. That is, the ground electrode 8 is spaced apart from the power feeder 5 and is also spaced apart from the radiator 7. The driving electrode 10 is provided on a surface of the second substrate 2 facing towards the first substrate 1 and electrically connected to a control signal wire 11. An orthographic projection of the driving electrode 10 on the first substrate 1 overlaps an orthographic projection of the power feeder 5 on the first substrate 1 and an orthographic projection of the ground electrode 8 on the first substrate 1, respectively. The liquid crystals 12 are located between the first substrate 1 and the second substrate 2.

It can be understood that the surface of the first substrate 1 facing towards the second substrate 2 and the surface of the second substrate 2 facing towards the first substrate 1 are each provided with an alignment film 13 configured to drive a normal deflection of the liquid crystals 12. In addition, each phase-shifting unit 4 further comprises a corresponding sealant 14 configured to define the liquid crystals 12.

For example, when the phased-array antenna is controlled to emit a wave beam, the radio frequency signal terminal 6 provides a radio frequency signal to the power feeder 5 in each of the plurality of phase-shifting units 4, the ground signal terminal 9 provides a ground signal to the ground electrode 8 in each of the plurality of phase-shifting units 4, and the control signal wire 11 provides a control signal to the driving electrode 10 in each of the plurality of phase-shifting units 4; the liquid crystals 12 in the phase-shifting unit 4 are deflected under an electric field formed by the driving electrode 10 and the ground electrode 8, resulting a change in a dielectric constant of the liquid crystals 12, so as to phase-shift the radio frequency signal transmitted in the power feeder 5. The phase-shifted radio frequency signal is radiated through the radiator 7 in the phase-shifting unit 4. The plurality of radio frequency signals radiated by the plurality of phase-shifting units 4 interferes to form a wave beam having a main lobe direction.

For one phase-shifting unit 4, the control signal wires 11 provide different control signals to the driving electrodes 10, and after the liquid crystals 12 are driven to deflect under the electric field formed by the driving electrode 10 and the ground electrode 8, the dielectric constant of the liquid crystals 12 varies, such that the phase-shifting units 4 phase-shift the radio frequency signals to different extents. That is, in the embodiment of the present disclosure, the phase-shifting unit 4 has a variable voltage of the control signal, and thus one phase-shifting unit 4 can radiate radio frequency signals having different phases. In this way, by adjusting the phases of the radio frequency signals radiated by the phase-shifting unit 4, the main lobe direction of the generated wave beam can be adjusted when the radio frequency signals radiated by the plurality of phase-shifting units 4 interfere with each other.

By using the phased-array antenna provided by the embodiment of the present disclosure, in a first aspect, each phase-shifting units 4 can radiate radiation signals having different phases in response to different control signals, so as to adjust the main lobe direction of the wave beam formed by the phased-array antenna, and compared with the related art, the number of the phase-shifting units 4, i.e., phase shifters, which is required in the phased-array antenna, can be greatly reduced, thereby effectively reducing the manufacture cost of the phased-array antenna. In a second aspect, the power feeder 5, the radiator 7 and the ground electrode 8 are all provided on the surface of the first substrate 1 facing towards the second substrate 2, such that in a process of forming the power feeder 5, the radiator 7 and the ground electrode 8, only a layer of metal such as copper is vapor-deposited on the surface of the first substrate 1, and then the power feeder 5, the radiator 7 and the ground electrode 8 can be formed by etching the layer of metal with one mask process, thereby simplifying the process and reducing the manufacture cost. In a third aspect, the phased-array antenna provided by the embodiment of the present disclosure exerts the phase-shifting function of the radio frequency signal by deflecting the liquid crystals, and due to a relatively high production capacity of liquid crystal panels, the manufacture cost of the phased-array antenna can also be reduced to a certain extent.

In addition, since the existing phase shifters are fixed phase-shifting devices, each phase shifter can only radiate a radio frequency signal of one phase, and when the plurality of antenna units select, through an electronic switch, a certain phase shifter to shift the phase, the main lobe direction of the wave beam is formed in a discontinuous manner. For example, when the antenna unit includes a limited number of phase shifters, if the main lobe direction of the wave beam of the phased-array antenna should be adjusted within a range of 10° to 50°, the antenna unit can only adjust the main lobe direction of the wave beam to 10°, 30°, 50° by switching different phase shifters. In contrast, with the phased-array antenna provided by the embodiment of the present disclosure, the degree of phase-shifting of the radio frequency signal by the phase-shifting unit 4 is controlled by the control signal, and the control signal can be adjusted to any value. In this way, a single phase-shifting unit 4 can perform various degrees of phase-shifting on the radio frequency signal, and the main lobe direction of the wave beam formed by the phased-array antenna can be finally adjusted to any direction in a range of 10° to 50°. That is, the main lobe direction of the wave beam formed by the phased-array antenna varies in a continuous manner.

In addition, it should be noted that the radiator 7 in the phase-shifting unit 4 can both radiate and receive signals. When the radiator 7 receives the radio frequency signal, the liquid crystals 12 in the phase-shifting unit 4 control the radio frequency signal to be phase-shifted, the phase-shifted radio frequency signal is transmitted to the radio frequency signal terminal 6 through the power feeder 5 and then outputted through the radio frequency signal terminal 6.

For example, further referring to FIG. 2, the phased-array antenna further includes a feeder 15, and the power feeders 5 of the plurality of phase-shifting units 4 are electrically connected to the same radio frequency signal terminal 6 through the feeder 15. In this way, the radio frequency signal provided by the radio frequency signal terminal 6 is transmitted to the power feeder 5 of each of the phase-shifting units 4 via the feeder 15 to ensure a normal operation of each of the phase-shifting units 4. In addition, with such a configuration, only one radio frequency signal terminal 6 is required in the phased-array antenna for transmitting the radio frequency signal to the power feeder 5 of each of the phase-shifting units 4, thereby reducing the number of the radio frequency signal terminal 6 required to be provided, and further reducing the manufacture cost of the phased-array antenna.

Figure 4:
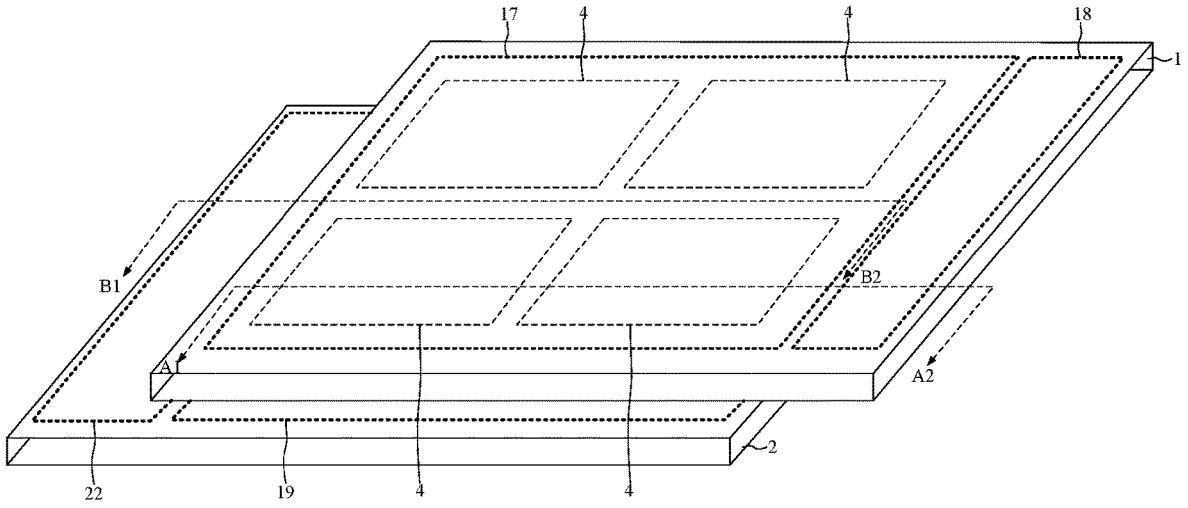
FIG. 4 is another structural schematic diagram of a phased-array antenna provided by an embodiment of the present disclosure.
Figure 5:
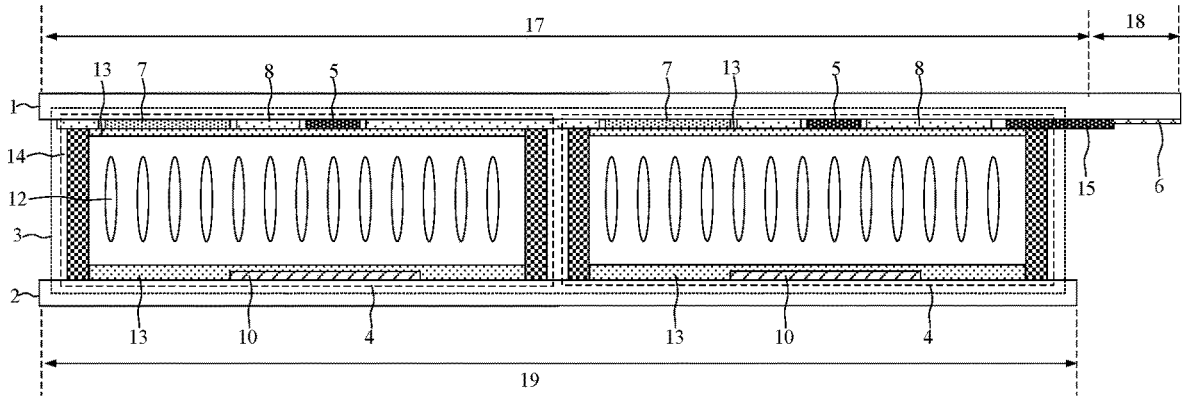
FIG. 5 is the cross-sectional view of the phased-array antenna along the $A_1$-$A_2$ line in FIG. 4.
Figure 6:
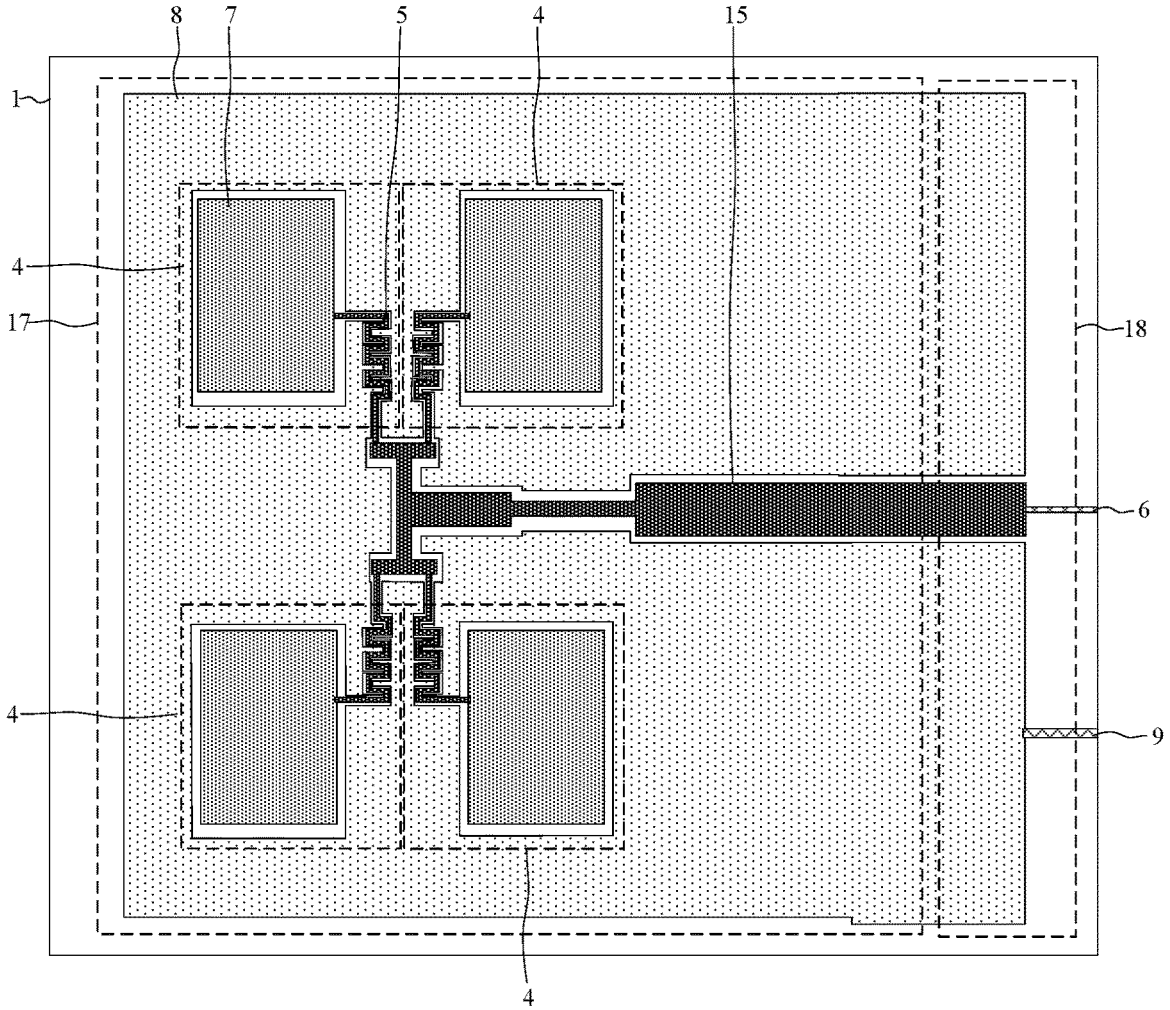
FIG. 6 is the top view of the first substrate in the phased-array antenna provided by an embodiment of the present disclosure.

FIG. 4 is another structural schematic diagram of a phased-array antenna provided by an embodiment of the present disclosure, FIG. 5 is the cross-sectional view of the phased-array antenna along the $A_1$-$A_2$ line in FIG. 4, and FIG. 6 is the top view of the first substrate in the phased-array antenna provided by an embodiment of the present disclosure. As shown in FIGS. 4-6, the first substrate 1 has a first phase-shifting region 17 and a connecting region 18, and the second substrate 2 has a second phase-shifting region 19. The first phase-shifting region 17 and the second phase-shifting region 19 are directly opposite to define the cavity 3. An orthographic projection of an edge of the second substrate 2 on the first substrate 1 does not overlap the connecting region 18. The feeder 15 and the radio frequency signal terminal 6 are electrically connected to each other in the connecting region 18. For example, the feeder 15 and the radio frequency signal terminal 6 are welded or metal-bonded in the connecting region 18 to form a transmission passage of the radio frequency signal through the radio frequency signal terminal 6, the feeder 15 and the power feeders 5. Therefore, the radio frequency signal provided by the radio frequency signal terminal 6 can be transmitted to the power feeder 5 of each of the phase-shifting units 4.

Moreover, the connecting region 18 is independent from the first phase-shifting region 17 of the first substrate 1, and the feeder 15 extends over the first phase-shifting region 17 to the connecting region 18 to form an electrical connection with the radio frequency signal terminal 6 in the connecting region 18. As the connecting region 18 protrudes from the edge of the second substrate 2, when the first substrate 1 and the second substrate 2 are arranged to be opposite to each other and the radio frequency signal terminal 6 and the feeder 15 are electrically connected by welding or metal bonding, it is avoided to shield the second substrate 2, which facilitates the welding or metal bonding process.

Further referring to FIG. 2, it is also possible that the driving electrodes 10 of the plurality of the phase-shifting units 4 are electrically connected to the control signal wires 11 in one-to-one correspondence. Based on such an arrangement, the control signal received by each of the phase-shifting units 4 are independent from each other, and by individually controlling the phase-shifting of the radio frequency signal by each of the phase-shifting units 4, an accuracy of adjusting the main lobe direction of the wave beam formed by the phased-array antenna can be improved.

Figure 7:
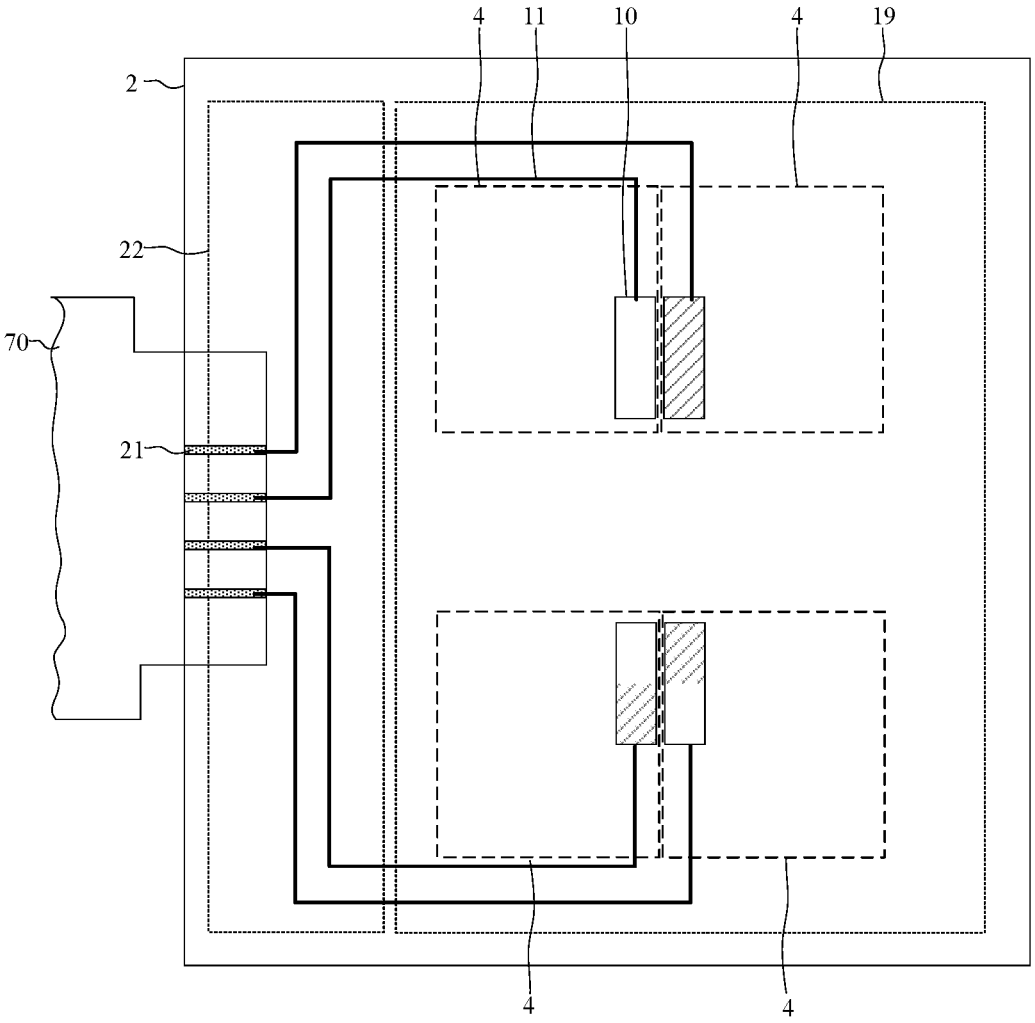
FIG. 7 is the top view of the second substrate in the phased-array antenna provided by an embodiment of the present disclosure.

FIG. 7 is the top view of a second substrate in the phased-array antenna provided by an embodiment of the present disclosure. As shown in FIG. 7, the phased-array antenna further includes a flexible printed circuit board 70, and the flexible printed circuit board 70 has a plurality of control signal terminals 21. The plurality of control signal terminals 21 is electrically connected to the plurality of control signal wires 11 in one-to-one correspondence, forming a transmission path of the control signal through the control signal terminal 21 of the flexible printed circuit board 70, the control signal wire 11, and the driving electrode 10. In this way, the control signal is transmitted to the driving electrode 10, and the electric field is formed between the driving electrode 10 and the ground electrode 8 to drive the liquid crystals 12 to be deflected and to phase-shift the radio frequency signal.

Figure 8:
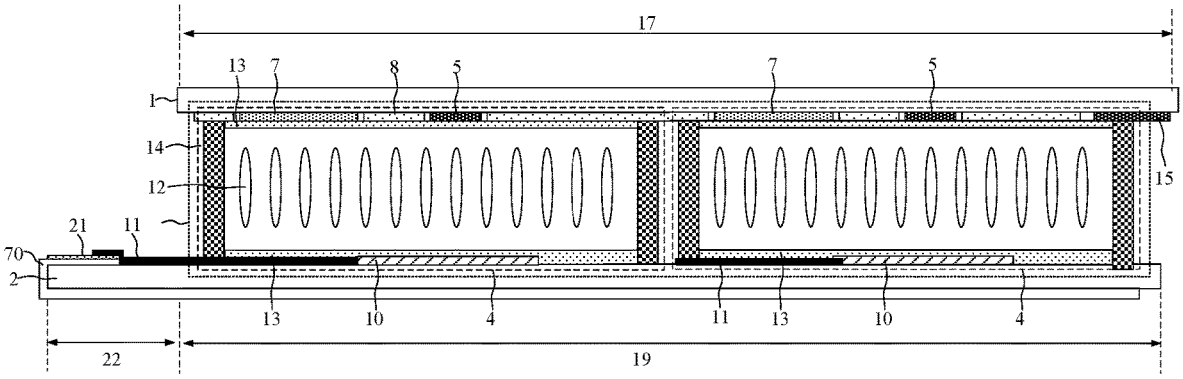
FIG. 8 is the cross-sectional view of the phased-array antenna along the $B_1$-$B_2$ line in FIG. 4.

FIG. 8 is the cross-sectional view of the phased-array antenna along the line $B_1$-$B_2$ in FIG. 4. In combination with FIG. 7 and FIG. 8, the first substrate 1 has a first phase-shifting region 17, and the second substrate 2 has a second phase-shifting region 19 and a bonding region 22. The first phase-shifting region 17 and the second phase-shifting region 19 are directly opposite to define the cavity 3, and an orthographic projection of an edge of the first substrate 1 on the second substrate 2 does not overlap the bonding region. The control signal terminal 21 and the control signal wire 11 are electrically connected to each other in the bonding region 22. For example, the control signal terminal 21 and the control signal wire 11 are pressed together through an anisotropic conductive film.

Since the bonding region 22 is independent from the second phase-shifting region 19 of the second substrate 2, i.e., the bonding region 22 protrudes from the edge of the first substrate 1, when the first substrate 1 and the second substrate 2 are arranged opposite to each other and the plurality of control signal terminals 21 and the plurality of control signal wires 11 of the flexible printed circuit board 70 are pressed to be electrically connected, the first substrate 1 is avoided to be shielded, which facilitates the pressing process.

Figure 9:
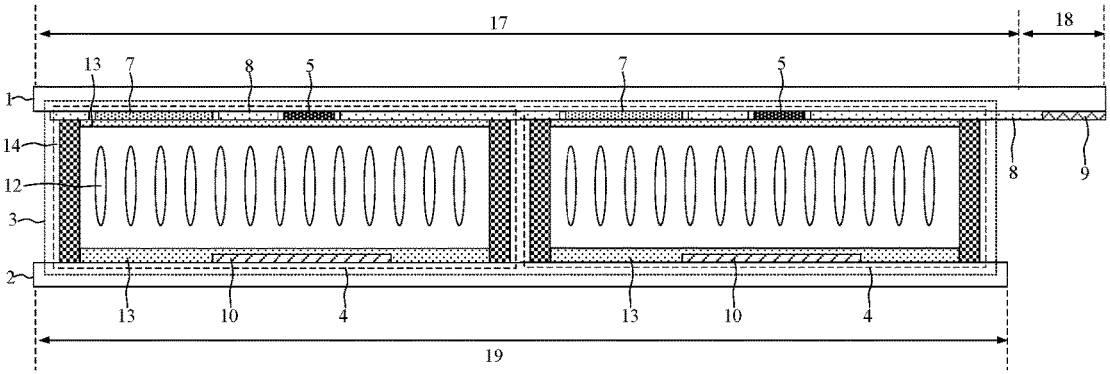
FIG. 9 is another cross-sectional view of the phased-array antenna along the $A_1$-$A_2$ line in FIG. 4.

FIG. 9 is another cross-sectional view of the phased-array antenna along an $A_1$-$A_2$ line in FIG. 4. As shown in FIG. 9, the first substrate 1 has a first phase-shifting region 17 and a connecting region 18, and the second substrate 2 has a second phase-shifting region 19. The first phase-shifting region 17 and the second phase-shifting region 19 are directly opposite to define the cavity 3. An orthographic projection of an edge of the second substrate 2 on the first substrate 1 does not overlap the connecting region 18. The ground electrode 8 and the ground signal terminal 9 are electrically connected to each other in the connecting region 18. For example, the ground electrode 8 and the ground signal terminal 9 are welded or metal-bonded in the connecting region 18, forming a transmission passage of the ground signal between the ground signal terminal 9 and the ground electrode 8. In this way, that the ground signal is transmitted to the ground electrode 8, and an electric field is formed between the ground electrode 8 and the driving electrode 10 to drive the liquid crystals 12 to be deflected and to phase-shift the radio frequency signal.

Moreover, since the connecting region 18 is independent from the first phase-shifting region 17 in the first substrate 1, i.e., the connecting region 18 protrudes from the edge of the second substrate 2, when the first substrate 1 and the second substrate 2 are arranged to opposite to each other and the ground electrode 8 and the ground signal terminal 9 are welded or metal-bonded to be electrically connected, the second substrate 2 can be avoided to be shielded, which facilitates the welding or metal bonding process.

Further referring to FIG. 2, for example, the ground electrodes 8 of the plurality of phase-shifting units 4 are in communication. In this case, only one ground signal terminal 9 is required to provide the ground signal to the ground electrodes 8 of all phase-shifting units 4. In this way, the number of the ground signal terminals 9 required to be provided can be reduced, thereby further reducing the manufacture cost of the phased-array antenna.

Figure 10:
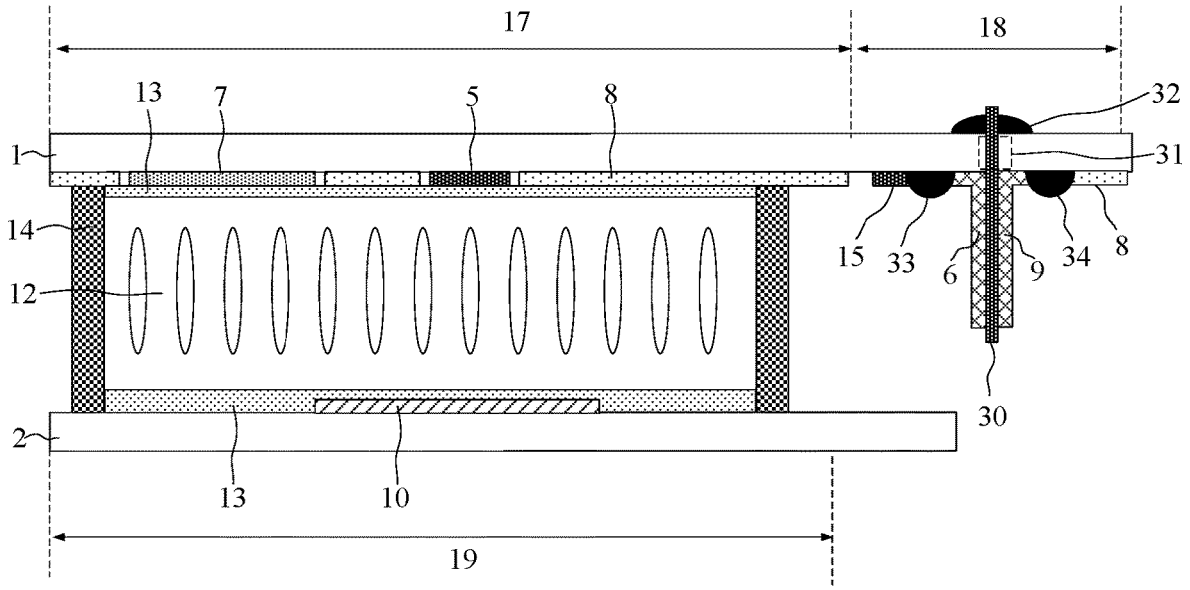
FIG. 10 is the schematic diagram of the arrangement of a radio frequency signal terminal and a ground signal terminal according to an embodiment of the present disclosure.

FIG. 10 is the schematic diagram of an arrangement of a radio frequency signal terminal and a ground signal terminal according to an embodiment of the present disclosure. As shown in FIG. 10, a support member 30 is further provided in the connecting region 18 of the first substrate 1, and the first substrate 1 is provided with a through hole 31. The support member 30 penetrates the through hole 31 and is fixed to the first substrate 1 by welding. For example, the support member 30 is fixed by a welding spot 32. The radio frequency signal terminal 6 and the ground signal terminal 9 are fixed to the first substrate 1 by respectively being fixed to the support member 30. Moreover, the radio frequency signal terminal 6 and the ground signal terminal 9 are provided on opposite sides of the support member 30, respectively, and an electrical connection between the radio frequency signal terminal 6 and the feeder 15 and an electrical connection between the ground signal terminal 9 and the ground electrode 8 are established on the opposite sides of the support member 30, respectively. For example, the radio frequency signal terminal 6 is electrically connected to the feeder 15 by welding, i.e., the radio frequency signal terminal 6 and the feeder 15 are welded together through a welding spot 33, and the ground signal terminal 9 is electrically connected to the ground electrode 8 by welding, i.e., the ground signal terminal 9 and the ground electrode 8 are welded together through a welding spot 34.

Figure 11:
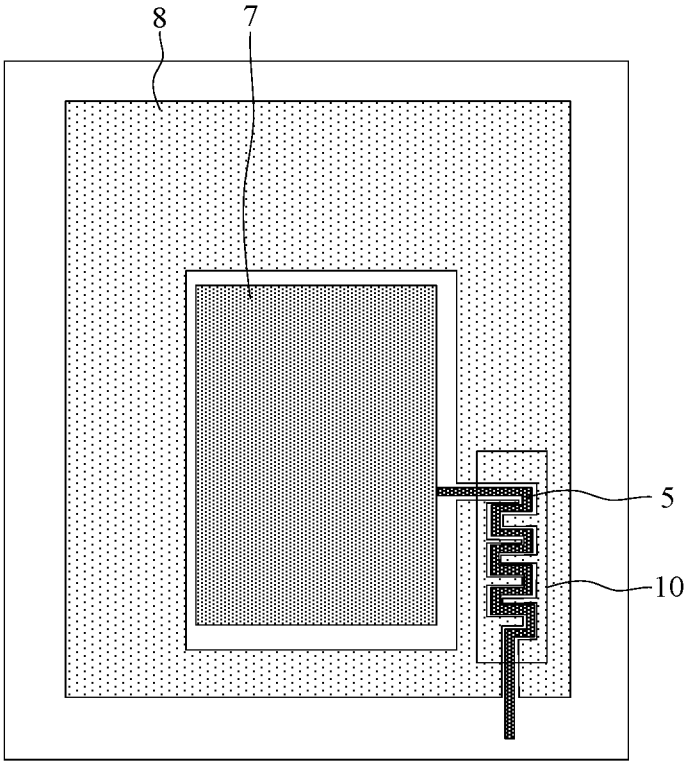
FIG. 11 is the power feeder and the driving electrode according to an embodiment of the present disclosure.

FIG. 11 is the power feeder and the driving electrode according to an embodiment of the present disclosure. As shown in FIG. 11, the power feeder 5 is a strip electrode, and the driving electrode 10 is a block electrode. An orthographic projection of the power feeder 5 on the second substrate 2 is located within an orthographic projection of the driving electrode 10 on the second substrate 2. Since the driving electrode 10 is provided as a block electrode and covers the power feeder 5, on the one hand, the radio frequency signals transmitted on the power feeder 5 can be phase-shifted under the electric field formed by the driving electrode 10, and on the other hand, an area where the driving electrode 10 directly faces the ground electrode 8 can also be enlarged to ensure that more liquid crystals 12 are under the effect of the electric field formed by the driving electrode 10 and the ground electrode 8. Therefore, a deflection efficiency of the liquid crystals 12 is enhanced, and the accuracy of the phase-shifting of the radio frequency signal is improved.

Figure 12:
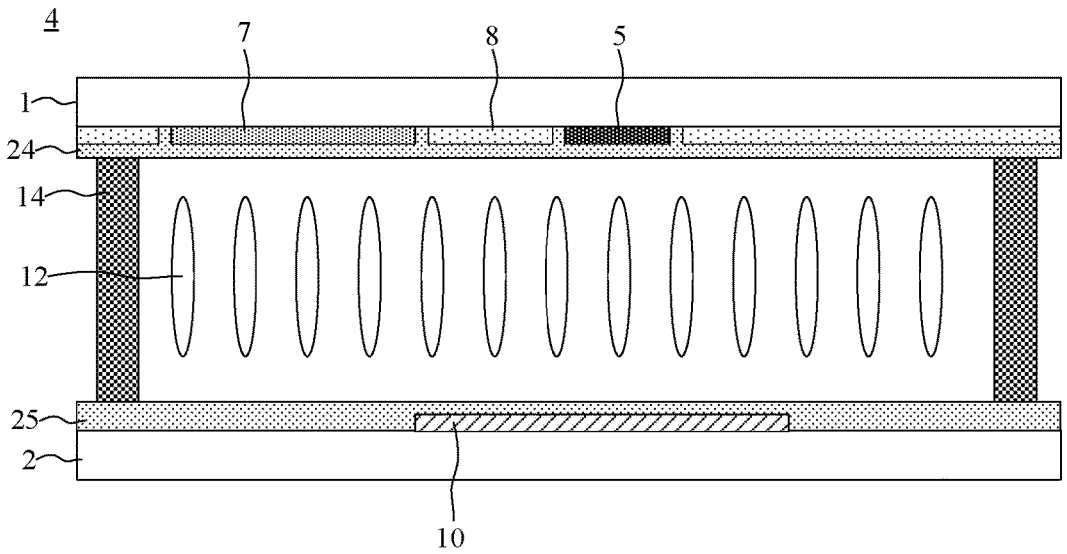
FIG. 12 is a single phase-shifting unit in a phased-array antenna according to an embodiment of the present disclosure.

FIG. 12 is a single phase-shifting unit of a phased-array antenna according to an embodiment of the present disclosure. As shown in FIG. 12, a first insulating layer 24 is provided on a side of the power feeder 5 facing away from the first substrate 1, and the first insulating layer 24 covers the power feeder 5, the radiator 7, and the ground electrode 8. As the first insulating layer 24 is provided to cover the power feeder 5, the radiator 7, and the ground electrode 8, the power feeder 5, the radiator 7 and the ground electrode 8 are prevented from being exposed, such that the power feeder 5, the radiator 7, and the ground electrode 8 are subject to less risk of being oxidized or corroded, thereby improving the stability and reliability of the phase-shifting unit 4.

Further referring to FIG. 12, a second insulating layer 25 is provided on a side of the driving electrode 10 facing away from the second substrate 2. Since the second insulating layer 25 is provided to cover the driving electrode 10, the driving electrode 10 can be prevented from being exposed, and the driving electrode 10 is subject to less risk of being oxidized or corroded, thereby improving the stability and reliability of the phase-shifting unit 4.

Figure 13:
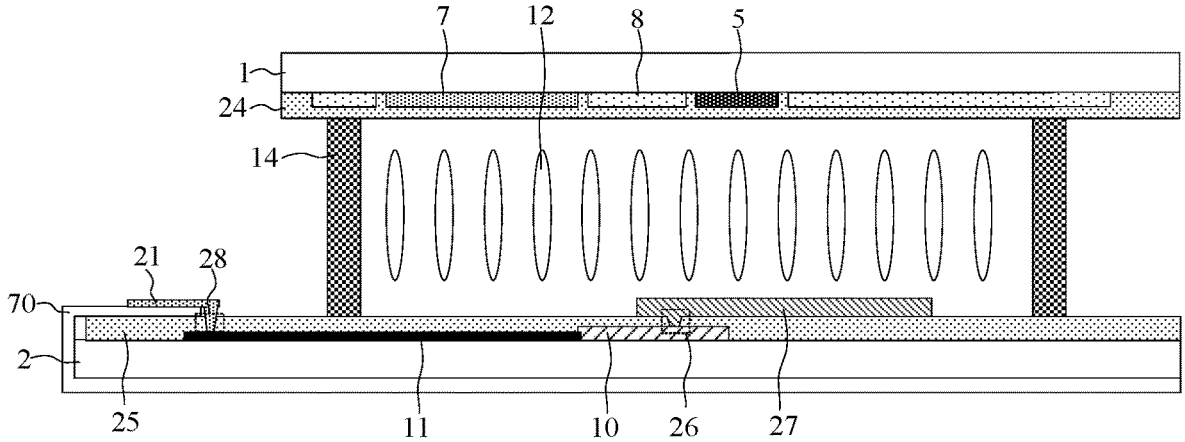
FIG. 13 is yet another single phase-shifting unit in a phased-array antenna according to an embodiment of the present disclosure.

FIG. 13 is yet another single phase-shifting unit in a phased-array antenna according to an embodiment of the present disclosure. As shown in FIG. 13, a first connecting via 26 is provided in the second insulating layer 25, an inert conductive layer 27 is provided on a side of the second insulating layer 25 facing away from the second substrate 2, and the inert conductive layer 27 is electrically connected to the driving electrode 10 through the first connecting via 26. An area of an orthographic projection of the inert conductive layer 27 on the second substrate 2 is larger than an area of an orthographic projection of the driving electrode 10 on the second substrate 2. The inert conductive layer 27 is a film layer formed of a conductive material that is inert and oxidative resistant.

By providing the inert conductive layer 27 electrically connected to the driving electrode 10, an electric field can be formed between the inert conductive layer 27 and the ground electrode 8 under the control signal. Since a coverage area of the inert conductive layer 27 is larger than a coverage area of the driving electrode 10, an area where the inert conductive layer 27 directly faces the ground electrode 8 can be enlarged, such that as more liquid crystals 12 are under the effect of the electric field formed by the inert conductive layer 27 and the ground electrode 8. Therefore, the deflection efficiency of the liquid crystals 12 is enhanced, and the accuracy of the phase shifting is improved. Moreover, the inert conductive layer 27 are less likely to be oxidized or corroded due to its characteristic of the oxidative resistance, and thus the stability and reliability of the operation of the phase-shifting unit 4 can be improved.

In order to further improve oxidation resistance of the inert conductive layer 27, the inert conductive layer 27 may be, for example, formed of an inert conductive material such as nickel, molybdenum, or indium tin oxide.

Further, the inert conductive layer 27 may be provided as a transparent inert conductive layer. In this case, before the phased-array antenna is put into use, an external detection device can be used to detect whether the liquid crystals 12 in the phased-array antenna are invalid. For example, a first polarizer is disposed on the side of the first substrate 1 facing away from the second substrate 2, and a second polarizer and an external light source are disposed on the side of the second substrate 2 facing away from the first substrate 1. When detecting the liquid crystals 12, the external light source provides light, the ground signal terminal 9 provides a ground signal to the ground electrode 8, the control signal wire 11 provides a control signal to the driving electrode 10, and the liquid crystals 12 in the phase-shifting unit 4 are deflected under the electric field formed by the driving electrode 10 and the ground electrode 8. The light passes through the transparent inert conductive layer 27 and is emitted through the gap between the ground electrode 8 and the power feeder 5 or the radiator 7. A deflection state of the liquid crystals 12 is detected based on a state of the emitted light, so as to confirm whether the liquid crystals 12 are invalid. If it is confirmed that the liquid crystals 12 are normal, the phased-array antenna can be put into use. In this way, it is ensured that the phased-array antenna put into use can operate normally, improving the accuracy of the main lobe direction of the wave beam formed by the phased-array antenna.

Further referring to FIG. 13, the second insulating layer 25 further covers the control signal wire 11, so to prevent the control signal wire 11 from being oxidized. In this way, the reliability of the control signal transmission is improved. In addition, a second connecting via 28 for electrically connecting the control signal wire is provided in the second insulating layer 25. For example, the control signal terminal 21 of the flexible printed circuit board 70 is electrically connected to the control signal wire 11 through the second connecting via 28, to form a signal transmission passage of the control signal.

Figure 14:
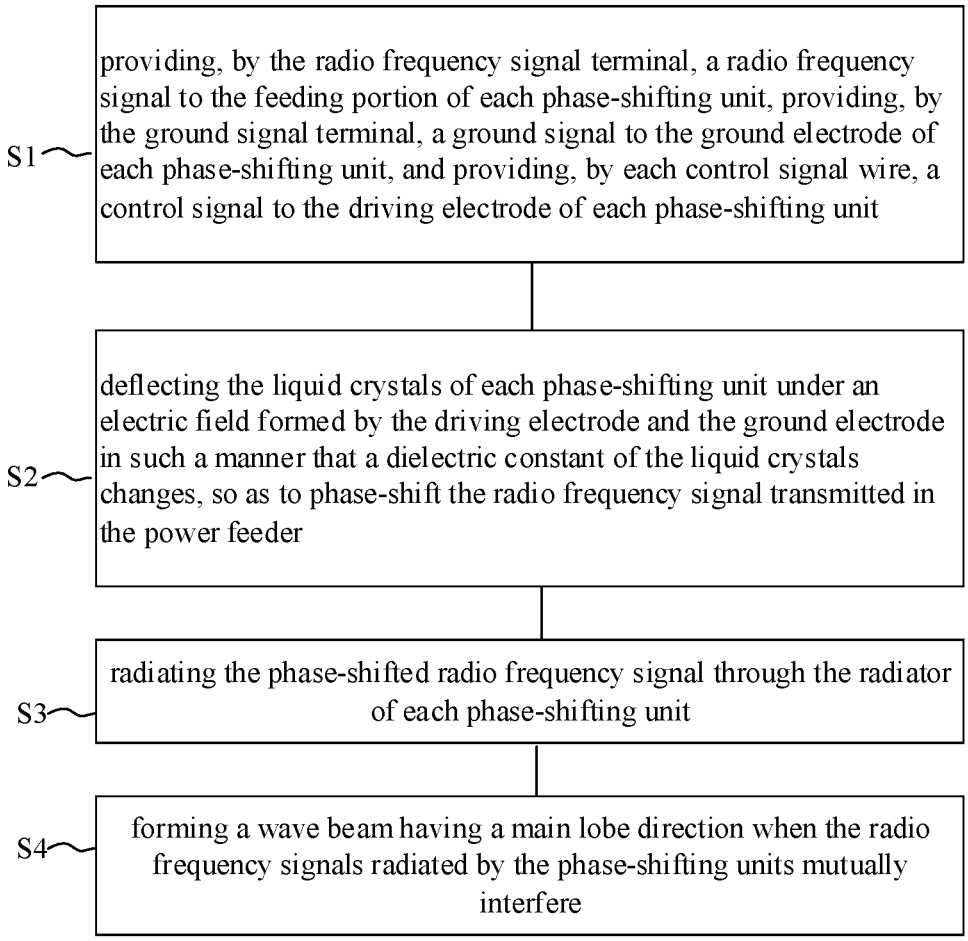
FIG. 14 is a flowchart of a control method according to an embodiment of the present disclosure.

An embodiment of the present disclosure further provides a control method of a phased-array antenna, and the control method is applied to the above phased-array antenna. FIG. 14 illustrates a flowchart of a control method according to the embodiment of the present disclosure. In combination with FIGS. 1 to 3 and FIG. 14, the control method includes the following steps.

Step S1: the radio frequency signal terminal 6 provides the radio frequency signal to the power feeder 5 of the phase-shifting unit 4, the ground signal terminal 9 provides a ground signal to the ground electrode 8 of the phase-shifting unit 4, and the control signal wire 11 provides the control signal to the driving electrode 10 of the phase-shifting unit 4.

Step S2: the liquid crystals 12 in the phase-shifting unit 4 are deflected under the electric field formed by the driving electrode 10 and the ground electrode 8, causing a change in a dielectric constant of the liquid crystals 12 to change, so as to phase-shift the radio frequency signal transmitted in the power feeder 5.

Step S3: the phase-shifted radio frequency signal is radiated through the radiator 7 of the phase-shifting unit 4.

Step S4: a wave beam having a main lobe direction is formed when the radio frequency signals radiated by the plurality of the phase-shifting units 4 mutually interfere.

For one phase-shifting unit 4, the control signal wires 11 provide different control signals to the driving electrodes 10, and after the liquid crystals 12 are driven to deflect under the electric field formed by the driving electrode 10 and the ground electrode 8, the dielectric constant of the liquid crystals 12 varies, such that the phase-shifting units 4 phase-shift the radio frequency signals to different extents. That is, in the embodiment of the present disclosure, the phase-shifting unit 4 has a variable voltage of the control signal, and thus one phase-shifting unit 4 can radiate radio frequency signals having different phases. In this way, by adjusting the phases of the radio frequency signals radiated by the phase-shifting unit 4, the main lobe direction of the generated wave beam can be adjusted when the radio frequency signals radiated by the plurality of phase-shifting units 4 interfere with each other.

By using the phased-array antenna provided by the embodiment of the present disclosure, each phase-shifting units 4 can radiate radiation signals having different phases in response to different control signals, so as to adjust the main lobe direction of the wave beam formed by the phased-array antenna, and compared with the related art, the number of the phase-shifting units 4, i.e., phase shifters, which is required in the phased-array antenna, can be greatly reduced, thereby effectively reducing the manufacture cost of the phased-array antenna.

In addition, the power feeder 5, the radiator 7 and the ground electrode 8 are all provided on the surface of the first substrate 1 facing towards the second substrate 2, such that in a process of forming the power feeder 5, the radiator 7 and the ground electrode 8, only a layer of metal such as copper is vapor-deposited on the surface of the first substrate 1, and then the power feeder 5, the radiator 7 and the ground electrode 8 can be formed by etching the layer of metal with one mask process, thereby simplifying the process and reducing the manufacture cost. Further, the phased-array antenna provided by the embodiment of the present disclosure exerts the phase-shifting function of the radio frequency signal by deflecting the liquid crystals, and due to a relatively high production capacity of liquid crystals panels, the manufacture cost of the phased-array antenna can also be reduced to a certain extent.

In addition, since the existing phase shifters are fixed phase-shifting devices, the phase shifter can only radiate a radio frequency signal of one phase, and when the plurality of antenna units select, through an electronic switch, a certain phase shifter to shift the phase, the main lobe direction of the wave beam is formed in a discontinuous manner. For example, when the antenna unit includes a limited number of phase shifters, if the main lobe direction of the wave beam of the phased-array antenna should be adjusted within a range of 10° to 50°, the antenna unit can only adjust the main lobe direction of the wave beam to 10°, 30°, 50° by switching different phase shifters. In contrast, with the phased-array antenna provided by the embodiment of the present disclosure, the degree of phase-shifting of the radio frequency signal by the phase-shifting unit 4 is controlled by the control signal, and the control signal can be adjusted to any value. In this way, a single phase-shifting unit 4 can perform various degrees of phase-shifting on the radio frequency signal, and the main lobe direction of the wave beam formed by the phased-array antenna can be finally adjusted to any direction in a range of 10° to 50°. That is, the main lobe direction of the wave beam formed by the phased-array antenna varies in a continuous manner.

In addition, it should be noted that the radiator 7 in the phase-shifting unit 4 can both radiate and receive signals. When the radiator 7 receives the radio frequency signal, the liquid crystals 12 in the phase-shifting unit 4 control the radio frequency signal to be phase-shifted, the phase-shifted radio frequency signal is transmitted to the radio frequency signal terminal 6 through the power feeder 5 and then outputted through the radio frequency signal terminal 6.

In conjunction with FIG. 2, the phased-array antenna further includes a feeder 15, and the power feeders 5 of the plurality of phase-shifting units 4 are electrically connected to the same radio frequency signal terminal 6 through the feeder 15.

Based on this, the process of the radio frequency signal terminal 6 providing the radio frequency signal to the power feeding part 5 in the phase-shifting unit 4 in step S1 includes: the radio frequency signal terminal 6 provides a radio frequency signal to the feeder 15, and the feeder 15 transmits the radio frequency signal to each power feeder 5 electrically connected thereto. With such configuration, only one radio frequency signal terminal 6 is required in the phased-array antenna to transmit the radio frequency signal to the power feeder 5 of each of the phase-shifting units 4, which reduces the number of the radio frequency signal terminals 6 required in the phased-array antenna, thereby reducing the manufacture cost of the phased-array antenna.

In combination with FIGS. 2, 7 and 8, the driving electrodes 10 of the plurality of phase-shifting units 4 are electrically connected to the plurality of the control signal wires 11 in one-to-one correspondence, the phased-array antenna further includes a flexible printed circuit board 70. The flexible printed circuit board 70 has a plurality of control signal terminals 21, and the plurality of control signal terminals 21 is electrically connected to the plurality of control signal wires 11 in one-to-one correspondence.

Based on this, the process of the control signal wire 11 providing the control signal to the driving electrode 10 in the phase-shifting unit 4 in step S1 includes: the plurality of control signal terminals 21 of the flexible printed circuit board 70 provides the control signal to the control signal wires 11 corresponding thereto, and the control signal wire 11 transmits the control signal to the driving electrode 10 electrically connected thereto. Based on this control method, the control signals received by each of the phase-shifting units 4 are independent from each other, and by individually controlling the phase-shifting of the radio frequency signal by each of the phase-shifting units 4, the accuracy of adjusting the main lobe direction of the wave beam formed by the phased-array antenna can be improved.

The above are only the preferred embodiments of the present disclosure and are not intended to limit the present disclosure. Any modifications, equivalents, or improvements made within the spirit and principles of the present disclosure shall fall within the scope of the present disclosure.

It should be noted that, the above-described embodiments are merely intended to illustrate but not to limit the present disclosure. Although the present disclosure is described in detail with reference to the above-described embodiments, those skilled in the art are able to modify the technical solutions described in the above embodiments or equivalently replace some or all of the technical features therein without departing from the scope of the present disclosure.

What is claimed is:

1. A phased-array antenna, comprising a first substrate and a second substrate that are opposite to each other, wherein a cavity is defined by the first substrate and the second substrate, a plurality of phase-shifting units is provided in the cavity, and each of the phase-shifting units comprises:

a power feeder provided electrically connected to a radio frequency signal terminal;

a radiator electrically connected to the power feeder;

a ground electrode electrically connected to a ground signal terminal and electrically insulated from the power feeder and the radiator respectively;

a driving electrode electrically connected to one of a plurality of control signal wires; and liquid crystals located between the first substrate and the second substrate, wherein the power feeder, the radiator and the ground electrode are sequentially provided on a surface of the first substrate facing towards the second substrate, and the driving electrode is provided on a surface of the second substrate facing towards the first substrate, and wherein an orthographic projection of the driving electrode on the first substrate overlaps an orthographic projection of the power feeder on the first substrate and an orthographic projection of the ground electrode on the first substrate, respectively.

2. The phased-array antenna according to claim 1, further comprising a feeder, wherein the power feeder in each said phase-shifting unit is electrically connected to the radio frequency signal terminal through the feeder.

3. The phased-array antenna according to claim 2, wherein the first substrate has a first phase-shifting region and a connecting region, the second substrate has a second phase-shifting region, the first phase-shifting region and the second phase-shifting region are directly opposite to define the cavity, and an orthographic projection of an edge of the second substrate on the first substrate does not overlap the connecting region, and wherein the feeder and the radio frequency signal terminal are electrically connected in the connecting region.

4. The phased-array antenna according to claim 1, wherein the driving electrodes of the plurality of phase-shifting units are electrically connected to the plurality of control signal wires in one-to-one correspondence.

5. The phased-array antenna according to claim 4, further comprising a flexible printed circuit board, wherein the flexible printed circuit board comprises a plurality of control signal terminals, and the plurality of control signal terminals is electrically connected to the plurality of control signal wires in one-to-one correspondence.

6. The phased-array antenna according to claim 5, wherein the first substrate has a first phase-shifting region, the second substrate has a second phase-shifting region and a bonding region, and an orthographic projection of an edge of the first substrate on the second substrate does not overlap the bonding region, and wherein the plurality of control signal terminals and the plurality of control signal wires are electrically connected to each other in the bonding region.

7. The phased-array antenna according to claim 1, wherein the first substrate has a first phase-shifting region and a connecting region, and the second substrate has a second phase-shifting region;

an orthographic projection of an edge of the second substrate on the first substrate does not overlap the connecting region, and wherein the ground electrode and the ground signal terminal are electrically connected to each other in the connecting region.

8. The phased-array antenna according to claim 7, wherein the ground electrodes of the plurality of phase-shifting units are connected with each other.

9. The phased-array antenna according to claim 1, wherein the power feeder is a strip electrode, the driving electrode is a block electrode, and an orthographic projection of the power feeder on the second substrate is located within an orthographic projection of the driving electrode on the second substrate.

10. The phased-array antenna according to claim 1, wherein a first insulating layer is provided on a side of the power feeder facing away from the first substrate, wherein the first insulating layer covers the power feeder, the radiator, and the ground electrode.

11. The phased-array antenna according to claim 1, wherein a second insulating layer is provided on a side of the driving electrode facing away from the second substrate.

12. The phased-array antenna according to claim 11, wherein a first connecting via is provided in the second insulating layer, wherein an inert conductive layer is provided on a side of the second insulating layer facing away from the second substrate, wherein the inert conductive layer is electrically connected to the driving electrode through the first connecting via, and wherein an area of an orthographic projection of the inert conductive layer on the second substrate is larger than an area of an orthographic projection of the driving electrode on the second substrate.

13. The phased-array antenna according to claim 12, wherein the inert conductive layer comprises one of nickel, molybdenum, and indium tin oxide.

14. The phased-array antenna according to claim 12, wherein the inert conductive layer is transparent.

15. The phased-array antenna according to claim 11, wherein the second insulating layer covers a corresponding one control signal wire of the plurality of control signal wires, and wherein a second connecting via for electrically connecting the control signal wire is provided in the second insulating layer.

16. A method of controlling the phased-array antenna according to claim 1, comprising:

providing, by the radio frequency signal terminal, a radio frequency signal to the power feeder of each of the plurality of phase-shifting units;

providing, by the ground signal terminal, a ground signal to the ground electrode of each of the plurality of phase-shifting units;

providing, by each of the plurality of control signal wires, a control signal to the driving electrode of each of the plurality of phase-shifting units;

deflecting the liquid crystals of each of the plurality of phase-shifting units by an electric field formed between the driving electrode and the ground electrode in such a manner that a dielectric constant of the liquid crystals changes, so as to phase-shift the radio frequency signal transmitted in the power feeder;

radiating the phase-shifted radio frequency signal through the radiator of each of the plurality of phase-shifting units; and forming a wave beam having a main lobe direction when the radio frequency signals radiated by the plurality of the phase-shifting units mutually interfere.

17. The method according to claim 16, wherein the phased-array antenna further comprises a feeder, wherein the power feeder in each of the plurality of phase-shifting units is electrically connected to the said radio frequency signal terminal through the feeder, and wherein said providing by the radio frequency signal terminal the radio frequency signal to the power feeder of each of the plurality of phase-shifting units comprises:

providing, by the radio frequency signal terminal, the radio frequency signal to the feeder, and providing, by the feeder, the radio frequency signal to a corresponding power feeder electrically connected thereto.

18. The method according to claim 16, wherein the driving electrodes of the plurality of phase-shifting units are electrically connected to the plurality of control signal wires in one-to-one correspondence, wherein the phased-array antenna further comprises a flexible printed circuit board comprising a plurality of control signal terminals, and the plurality of control signal terminals is electrically connected to the plurality of control signal wires in one-to-one correspondence, and wherein said providing by each of the plurality of control signal wires a control signal to the driving electrode of each of the plurality of phase-shifting units comprises:

providing, by each of the plurality of control signal terminals of the flexible printed circuit board, the control signal to a corresponding control signal wire of the plurality of control signal wires, and providing, by the corresponding control signal wire, the control signal to the driving electrode electrically connected to the corresponding control signal wire.

* * * * *